US008251667B2

(12) United States Patent
Wilson et al.

(10) Patent No.: US 8,251,667 B2
(45) Date of Patent: Aug. 28, 2012

(54) LOW STRESS CIRCUMFERENTIAL DOVETAIL ATTACHMENT FOR ROTOR BLADES

(75) Inventors: Ian David Wilson, Simpsonville, SC (US); Kenneth Damon Black, Travelers Rest, SC (US); Bradley Scott Carter, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 625 days.

(21) Appl. No.: 12/469,157

(22) Filed: May 20, 2009

(65) Prior Publication Data

US 2010/0296936 A1 Nov. 25, 2010

(51) Int. Cl.
*F01D 5/30* (2006.01)

(52) U.S. Cl. ..... 416/217; 416/215

(58) Field of Classification Search ..... 416/215–218; 29/889.21

See application file for complete search history.

(56) References Cited

U.S. PATENT DOCUMENTS

| | | | | |
|---|---|---|---|---|
| 3,742,706 | A * | 7/1973 | Klompas | 60/726 |
| 4,451,203 | A | 5/1984 | Langley | |
| 4,818,182 | A * | 4/1989 | Bouru | 416/215 |
| 5,100,292 | A | 3/1992 | Matula et al. | |
| 5,271,718 | A | 12/1993 | Mitchell, Jr. et al. | |
| 5,310,318 | A | 5/1994 | Lammas et al. | |
| 5,522,706 | A * | 6/1996 | Mannava et al. | 416/215 |
| 5,584,658 | A | 12/1996 | Stenneler | |
| 6,033,185 | A | 3/2000 | Lammas et al. | |
| 2007/0014667 | A1 | 1/2007 | Pickens et al. | |

* cited by examiner

*Primary Examiner* — Marcos D. Pizarro
*Assistant Examiner* — Sue Tang
(74) *Attorney, Agent, or Firm* — Dority & Manning, P.A.

(57) ABSTRACT

A retaining system is provided for circumferential entry rotor dovetails inserted into dovetail slot in a rotor. A plurality of rotor blade dovetails are circumferentially slidable into and along the dovetail slot, with each rotor blade dovetail having a neck and a pair of oppositely oriented lobes. A plurality of rail segments are circumferentially slid into channels in the dovetail slot between the dovetail lobes and the respective disk hoops. The rail segments define a first pressure face that engages against an outward pressure face of the dovetail lobes, and a second pressure face that engages against an inward pressure face of the respective disk hoop component.

20 Claims, 5 Drawing Sheets

LOW STRESS CIRCUMFERENTIAL DOVETAIL ATTACHMENT FOR ROTOR BLADES

FIELD OF THE INVENTION

The present invention relates to an attachment system for rotor blades, and more particularly to a low stress attachment configuration for rotor blades mounted in a circumferential groove in the rotor disk.

BACKGROUND

A conventional gas turbine includes a rotor with various rotor blades mounted to rotor disks in the fan, compressor, and turbine sections thereof. Each blade includes an airfoil over which the pressurized air flows, and a platform at the root of the airfoil that defines the radially inner boundary for the airflow. The blades are typically removable, and therefore include a suitable dovetail configured to engage a complementary dovetail slot in the perimeter of the rotor disk. The dovetails may either be axial-entry dovetails or circumferential-entry dovetails that engage corresponding axial or circumferential slots formed in the disk perimeter. A typical dovetail includes a neck of minimum cross sectional area extending radially inwardly from the bottom of the blade platform. The neck diverges outwardly into a pair of opposite dovetail lobes.

Components of a conventional gas turbine are illustrated, for example, in FIG. 1 wherein a rotor 12 includes a plurality of rotor disks 20 disposed coaxially with the centerline axis 18 of the turbine. A plurality of circumferentially spaced rotor blades 22 are removably fixed to the disk and extend radially outward therefrom. Each blade 22 has a longitudinal centerline axis 24 and includes an airfoil section 26 having a leading edge 26*a* and a trailing edge 26*b* (in the direction of airflow over the blade 22). Each blade 22 has a platform 28 that provides a portion of the radially inner boundary for the airflow over the airfoils 26, and an integral dovetail 30 that extends radially inward from the platform 28 and is configured for axial entry into circumferentially spaced apart and axially extending dovetail slots defined between corresponding disk posts in the rotor disk 20. The axial slots and disk posts extend essentially the full axial thickness of the disk between its axially forward and aft faces.

For circumferential dovetails, a single dovetail slot is formed between forward and aft continuous circumferential posts or "hoops" and extends circumferentially around the entire perimeter of the disk. An example of this type of configuration is shown in U.S. Pat. No. 6,033,185. The circumferential slot may be locally enlarged at one location for allowing the individual circumferential dovetails to be initially inserted therein and then repositioned circumferentially along the dovetail slot until the entire slot is filled with a full row of the blades. In an alternate conventional configuration, the circumferential slot is provided with circumferentially spaced load-lock slots, as depicted in FIG. 2 of this application. Referring to FIG. 2, the rotor disk 20 has a continuous circumferential slot 18 defined between continuous hoops 20, 22. Loading slots 14 are provide for initial insertion and rotation of individual rotor blade dovetails. Lock slots 16 are provided for insertion of locks to retain the blades in the slot 18.

In the circumferential dovetail slot, the forward and aft hoops include complementary lobes that cooperate with the dovetail lobes to radially retain the individual blades against centrifugal force during turbine operation. Each dovetail lobe includes a radially outwardly facing outer pressure surface or face that engages a corresponding radially inwardly facing pressure surface or face of the respective disk post. The centrifugal load generated by the blade during rotation is carried radially outward from the dovetail lobes and transferred to the respective disk posts at the engaging outer (dovetail lobe) and inner (disk post) pressure faces.

For the blade dovetails, maximum centrifugal stress is experienced at the necks, which stress must be limited by design to ensure blade life. A typical compressor blade is designed for an infinite life, which requires suitably large dovetails and necks for maintaining centrifugal stress suitably below the strength limits of the blade material. For the rotor disks, maximum stress imparted by the centrifugal load of the blades and axial loads is experienced primarily at the dovetail hoops. As generally recognized in the art, the hoop stress for the load-lock slot configuration is more limiting than for a continuous slot configuration since the locking and loading slots form discontinuities that are prone to mechanical and thermal stresses, and fatigue.

Examples of various proposals to reduce stress in dovetail configurations may be found, for example, in U.S. Pat. No. 6,033,185 cited above; U.S. Pat. Nos. 5,310,318; 5,100,292; 5,271,718; 5,584,658; 4,451,203; and U.S. Pat. App. Pub. 2007/0014667.

The art is continuously seeking improved dovetail designs that reduce stress and extend the useful life of rotor components, particularly as the size and demands placed on gas turbines, and resulting stresses, grow.

BRIEF DESCRIPTION OF THE INVENTION

The present invention provides a unique dovetail retention system that is believed to significantly reduce stresses at the dovetail neck and slot hoops in a continuous circumferential-entry slot configuration. Additional aspects and advantages of the invention may be set forth in part in the following description, or may be obvious from the description, or may be learned through practice of the invention.

A retaining system for circumferential entry rotor dovetails is provided, wherein a rotor has a rotor disk with forward and aft hoops that define a continuous circumferentially extending dovetail slot. Each of the hoops defines a radially inward pressure face within the dovetail slot. A plurality of rotor blades are mounted to the rotor disk, with each rotor blade having a platform and a dovetail extending from the platform. The dovetail has a neck and a pair of oppositely oriented lobes, with each lobe defining an outward pressure face. The dovetails are slidable into and along the dovetail slot such that a plurality of the rotor blades are circumferentially spaced around the rotor disk within the dovetail slot. A plurality of rail segments having a unique cross-sectional shape and arc length slide into channels in the dovetail slot between the dovetail lobes and the hoops. Each rail segment defines a first pressure face that engages against a respective outward pressure face of the dovetail lobe, and a second pressure face that engages against the hoop inward pressure face. At least one pair of locking rail segments may be provided, with each locking rail segment having a smaller cross-sectional shape than the other rail segments so as to fit into the dovetail slot channels yet provide access for subsequent radial insertion of a last one dovetail into the slot between the locking rail segments. A locking mechanism is configured to draw the locking rail segments radially outward into engagement with the outward pressure faces of the dovetail lobes and the inward pressure faces of the hoops.

The present invention also encompasses a dovetail retaining system separate from a rotor disk, the system configured for retaining circumferential entry rotor dovetails in a rotor having a rotor disk with forward and aft hoops that define a continuous circumferentially extending dovetail slot. The dovetail retaining system includes a plurality of rotor blades, with each of the rotor blades having a platform and a dovetail extending from the platform. The dovetail has a neck and a pair of oppositely oriented lobes, with each of the lobes defining an outward pressure face. The dovetails are configured so as to circumferentially slide into and along the dovetail slot in the rotor disk such that the plurality of rotor blades are circumferentially spaced around the rotor disk within the dovetail slot. The system includes a plurality of rail segments, with each of the rail segments having a cross-sectional shape and arc length such that a pair of the rail segments circumferentially slide into channels in the dovetail slot between the dovetail lobes and the rotor disk hoops. Each of said rail segments defines a first pressure face that engages against the lobe outward pressure face, and a second pressure face configured to engage against an inward hoop pressure face.

The present invention also includes unique methods for retaining circumferential entry rotor dovetails in a circumferentially extending dovetail slot that is defined between radially inward faces of rotor disc hoops, wherein the dovetails extend from a rotor blade platform and have a neck and a pair of oppositely oriented lobes. In a particular embodiment, the method includes radially inserting the dovetails into the dovetail slot and then circumferentially sliding rail segments into channels in the dovetail slot defined between the dovetail lobes and the hoop inward faces. The rail segments engage the outward pressure faces of the lobes and inward pressure faces of the hoops to transfer and distribute centrifugal load of the rotor blades to the rotor disk. The method may further include sliding locking rail segments into the channels prior to radially the last one of the dovetails into the dovetail slot, and thereafter drawing the locking rail segments radially outward within the channels so as to engage the outward pressure faces of the lobes and inward pressure faces of the hoops. This drawing process may be accomplished, for example, by engaging a locking mechanism provided with each locking rail segment through an access opening in the rotor blade platform.

BRIEF DESCRIPTION OF THE DRAWINGS

The invention, in accordance with preferred and exemplary embodiments, together with further aspects and advantages thereof, is more particularly described in the following detailed description taken in conjunction with the accompanying drawings in which.

DETAILED DESCRIPTION

Figure 1:
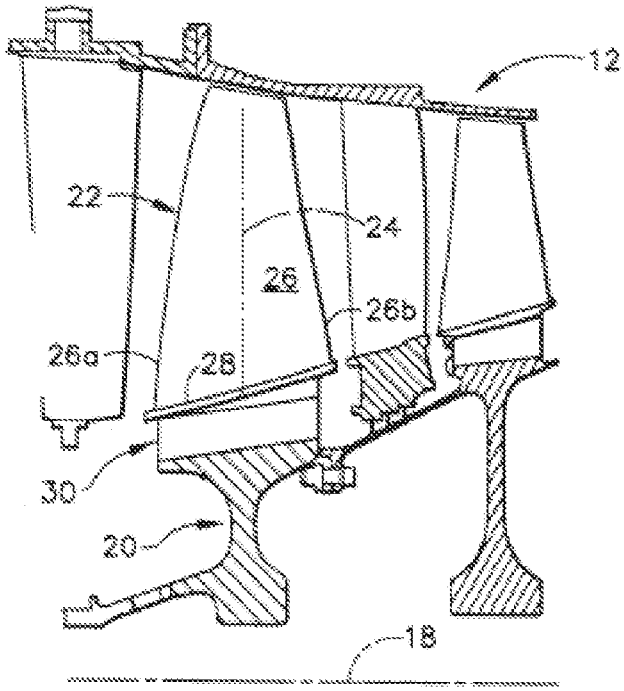
Fig. 1 Prior Art
FIG. 1 is a partial sectional view of components of a conventional gas turbine configuration.
Figure 2:
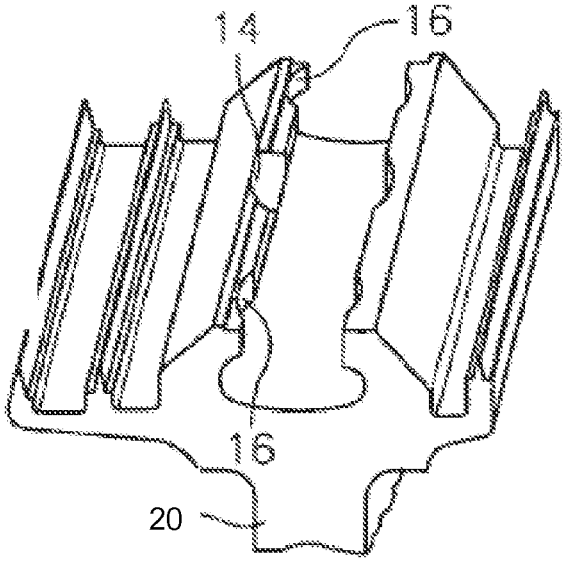
Fig. 2 Prior Art
FIG. 2 is a partial sectional view of a conventional rotor disk configuration for circumferential entry rotor blades.

Reference is now made to particular embodiments of the invention, one or more examples of which are illustrated in the drawings. Each embodiment is presented by way of explanation of aspects of the invention, and should not be taken as a limitation of the invention. For example, features illustrated or described with respect to one embodiment may be used with another embodiment to yield still further embodiment. It is intended that the present invention include these and other modifications or variations made to the embodiments described herein.

Figure 3:
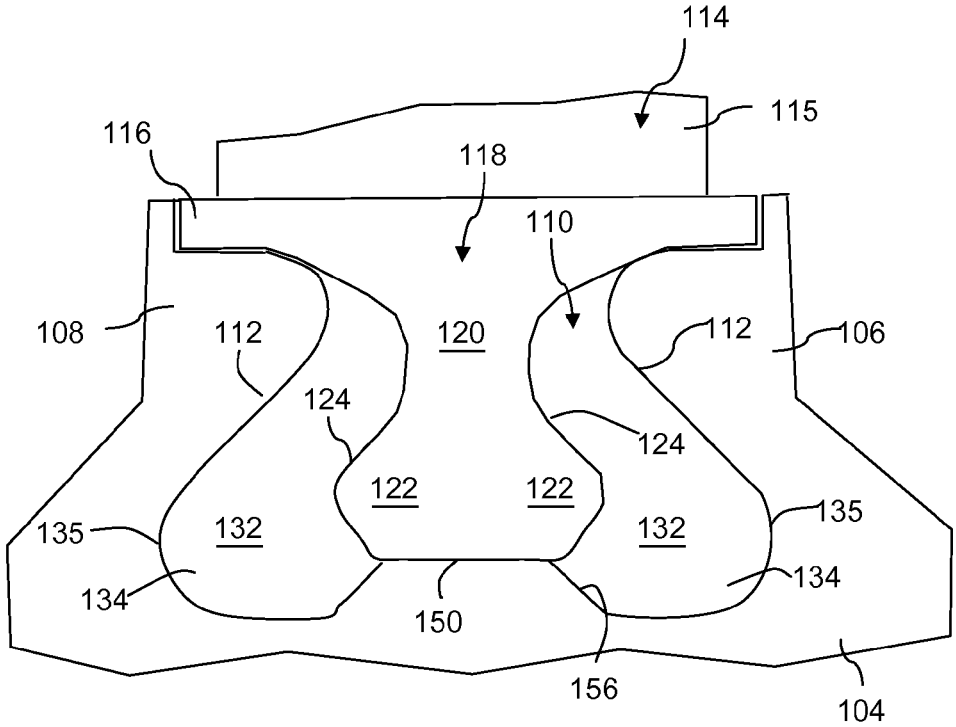
FIG. 3 is a cross-sectional view of an embodiment of a dovetail retaining system for circumferential entry rotor blades in accordance with aspects of the invention.
Figure 4:
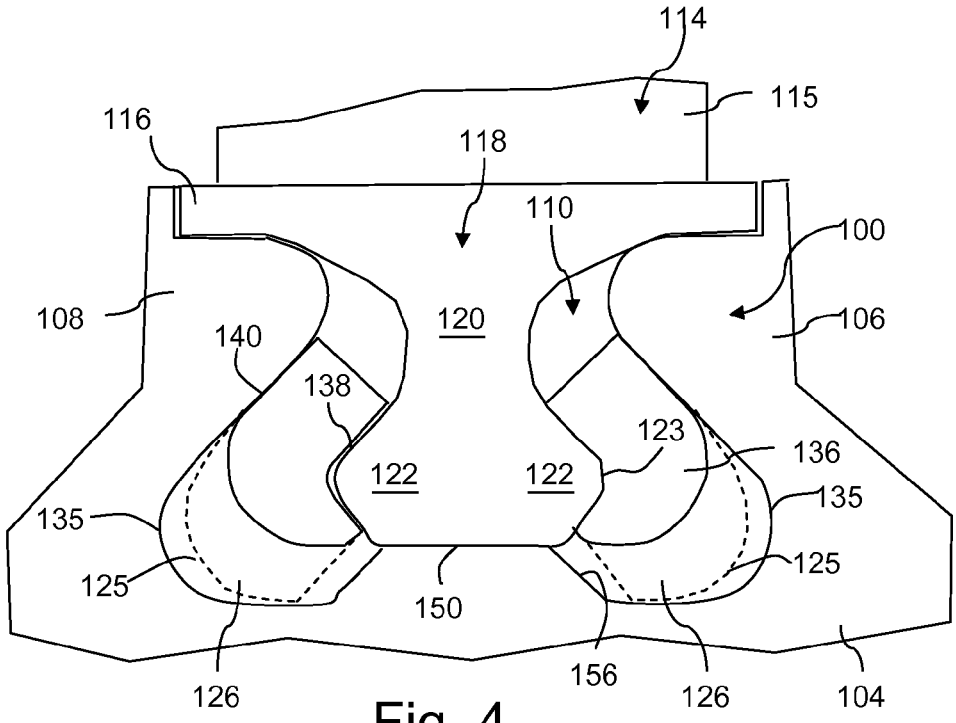
FIG. 4 is a cross-sectional view of the embodiment of FIG. 3 illustrating rail segments and retaining rail segments in the dovetail slot channels.
Figure 5:
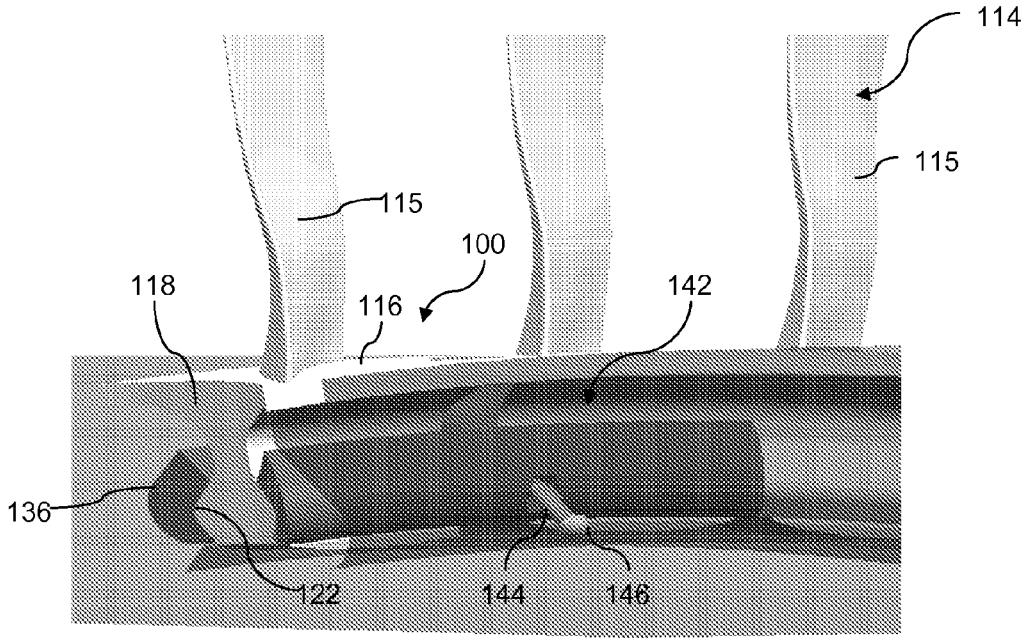
FIG. 5 is a sectional perspective view illustrating an embodiment of the locking rail segments.
Figure 6:
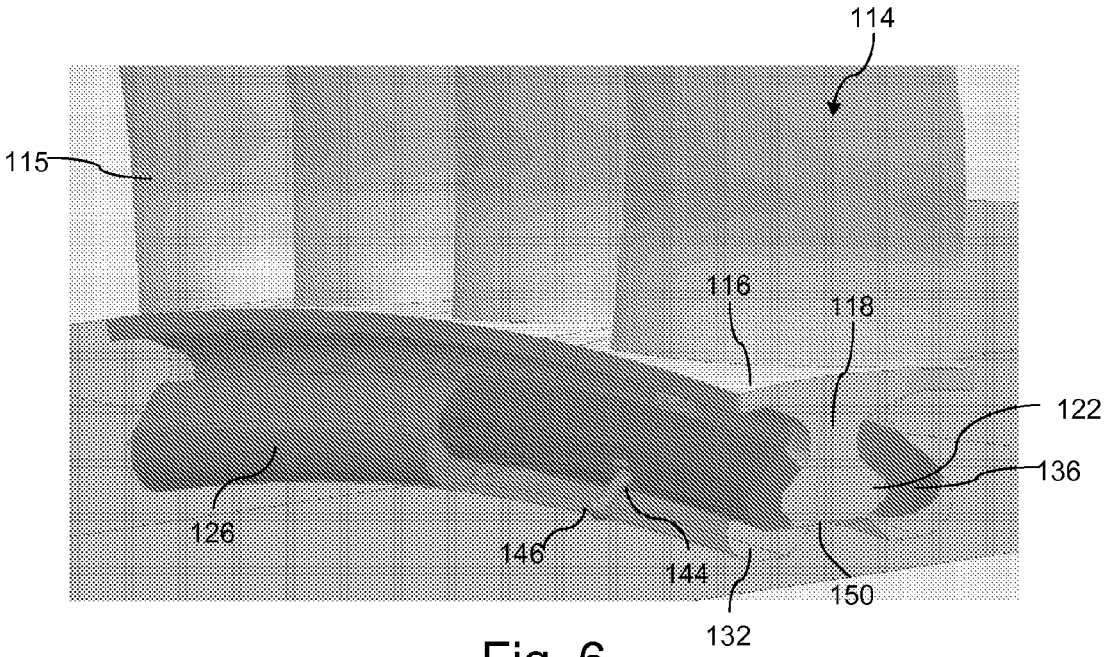
FIG. 6 is an alternate sectional perspective view of the embodiment of FIG. 5.

Referring to the perspective views in FIGS. 5 and 6, and the diagram views of FIGS. 3 and 4, a plurality of circumferentially adjoining rotor blades 114 are removably mounted in a dovetail slot 110 defined in a rotor disk 104 of a rotor 100. Each blade 114 includes an airfoil section 115 over which air is channeled during operation of the gas turbine. A platform 116 is integrally joined to a root of the airfoil 115 and defines the radially inner flow path boundary for air moving over the rotor blades 114.

Each blade 114 includes a circumferential-entry dovetail 118 integrally joined to the bottom of the platform 116 and extending radially inward therefrom. Each dovetail 118 includes a neck 120 and a pair of dovetail lobes 122. As particularly illustrated in FIGS. 3 and 4, in one embodiment the dovetail 118 has a symmetrical cross-sectional profile relative to a radial (with respect to a rotational axis of the rotor) axis through the dovetail 118.

As particularly illustrated in FIGS. 3 and 4, the dovetail slot 110 formed in the rotor disk 104 is defined by a circumferentially continuous forward ring or "hoop" 106, and a circumferentially continuous aft hoop 108. These hoops 106, 108 define the dovetail slot 110 therebetween. Each of the hoops 106, 108 defines an inward pressure face 112 and a respective channel 132, which further defines a lobe recess 132. In the illustrated embodiment, the dovetail slot 110 has a symmetrical cross-sectional profile relative to a radial centerline axis.

Each of the lobes 122 of the rotor dovetail 118 defines an outward pressure face 124 that is oriented towards the inward pressure face 112 of a respective hoop 106 or 108, as particularly illustrated in FIGS. 3 and 4.

In the illustrated embodiments, the dovetail slot 110 includes a raised ridge 156 at the bottom or most radially inward point. The dovetail 118 includes a dovetail bottom 150 that engages against the surface of the raised ridge 156.

As is commonly understood with respect to circumferential-entry dovetails, a plurality of the rotor blades 114 are inserted into the circumferentially extending dovetail slot 110 and are slid around the slot until a plurality of the rotor blades 114 are in an abutting relationship around the circumference of the rotor, as particularly illustrated by the partial sectional view of FIG. 6.

Referring to FIGS. 3 through 6 in general, a plurality of rail segments 126 are inserted into and circumferentially moved within the dovetail slot 110 along the channels 132 on opposite sides of the dovetail 118. These retaining rail segments 126 may have a cross-sectional profile that generally corresponds to the lobe recesses 134 along the channels 132 so as to positively seat within the channels 132. For example, in the illustrated embodiment, the rail segments 136 have an arcuate lobe surface 125 that generally corresponds in shape and dimensions to an arcuate surface 135 that defines the lobe recess 134. This profile ensures that the rail segments 126 are properly oriented and securely positioned within the dovetail slot 110.

In FIG. 4, the retaining rail segments 126 are illustrated in dashed lines. The rail segments 126 are further illustrated in FIG. 10. The rail segments 126 include a first pressure face 128 that engages against the inward pressure face 112 of the corresponding hoop 106, 108. The rail segments 126 include a second pressure face 130 that engages against the outward pressure face 124 of the respective hoop 106 or 108. In this manner, centrifugal forces generated by the dovetail 118 in operation of the rotor are transferred from the dove tail lobes 122 through the interface of the pressure faces 124 and 130, through the rail segments 126, and into the hoops 106, 108 through the interface of pressure faces 128 and 112.

Figure 10:
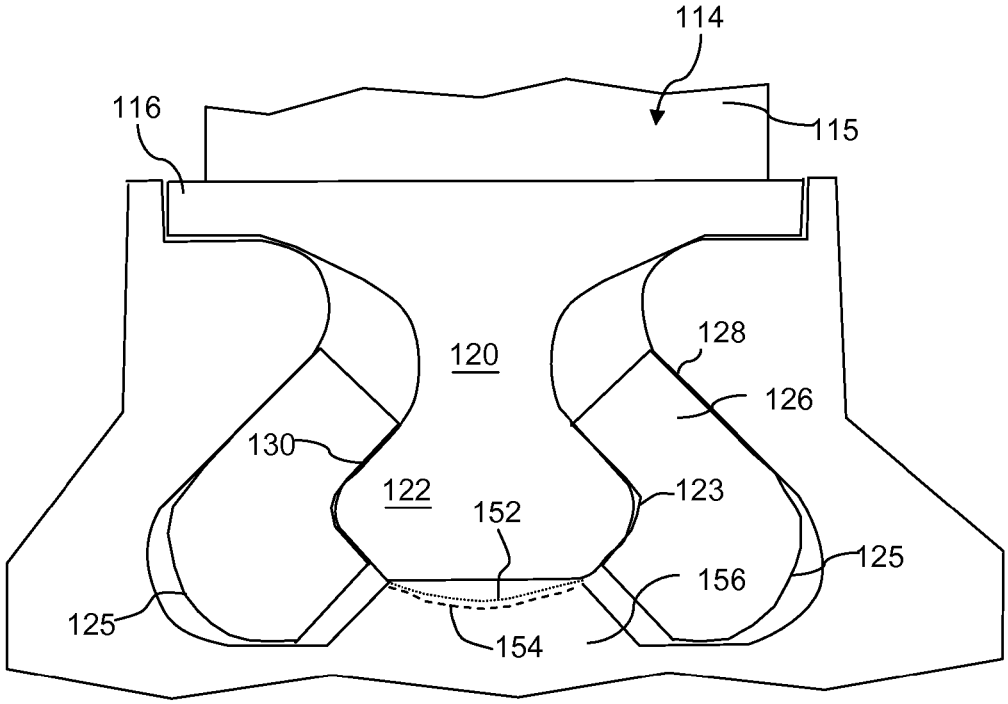
FIG. 10 is an end view illustrating the scalloped dovetail bottoms and dovetail recesses.

As illustrated in the embodiments of FIGS. 4 and 10, the retaining rail segments 126 may include an arcuate radially inward surface 123 that has a shape and dimensions so as to generally wrap around the lobes 122 of the dovetail 118.

The number and arc length of the rail segments 126 will vary depending on the rotor circumference, number of rotor blades, and any other number of design variables. Generally, the rail segments 126 will have an arc length so as to span at least two adjacent rotor blades 114, as illustrated for example in the perspective view of FIG. 6.

It should be appreciated that the shape and configuration of the retaining rail segments 126 and corresponding channels 132 and associated lobe recesses 134 illustrated in the drawings is not a limitation of the invention. The shape and configuration of these components may vary widely within the scope and spirit of the invention.

Once the entire dovetail slot 110 is filled with a full circumferential row of rotor blades 114, and the respective retaining rail segments 126 have been positioned within the forward and aft channels 132 around the circumference of the dovetail slot 110, locking rail segments 136 are radially placed into the dovetail slot 110 prior to radial insertion of the last ones of the dovetails 118. An embodiment of the locking rail segments 136 are illustrated in the solid lines in FIG. 4 and in the perspective view of FIG. 7. These locking rail segments 136 have a reduced size and configuration so that they initially fit into the lobe recesses 134 of the charmers 132 and leave sufficient spacing therebetween for radial insertion of the remaining dovetails 118. The locking rail segments define a first pressure face 138 that engages against the outward pressure face 124 of a respective lobe 122, and a second pressure face 140 that engages against the inward pressure face 112 of a respective hoop 106, 108. The locking rail segments 136 may have the same or different arc lengths and, desirably, extend along at least two adjacent rotor blades.

After insertion of the last ones of the dovetails 118, the locking rail segments 136 are drawn radially outward into engagement with the lobes 122. The locking rail segments 136 also may have a shape and configuration so as to wrap around the lobes 122, as illustrated in FIG. 4. In the final position of the locking rail segments 136 as indicated in FIG. 4, centrifugal force is distributed from the dovetail lobes 122 through the locking rail segments 136 and into the rotor disk hoops 106, 108 as described above with respect to the retaining rail segments 126.

Figure 7:
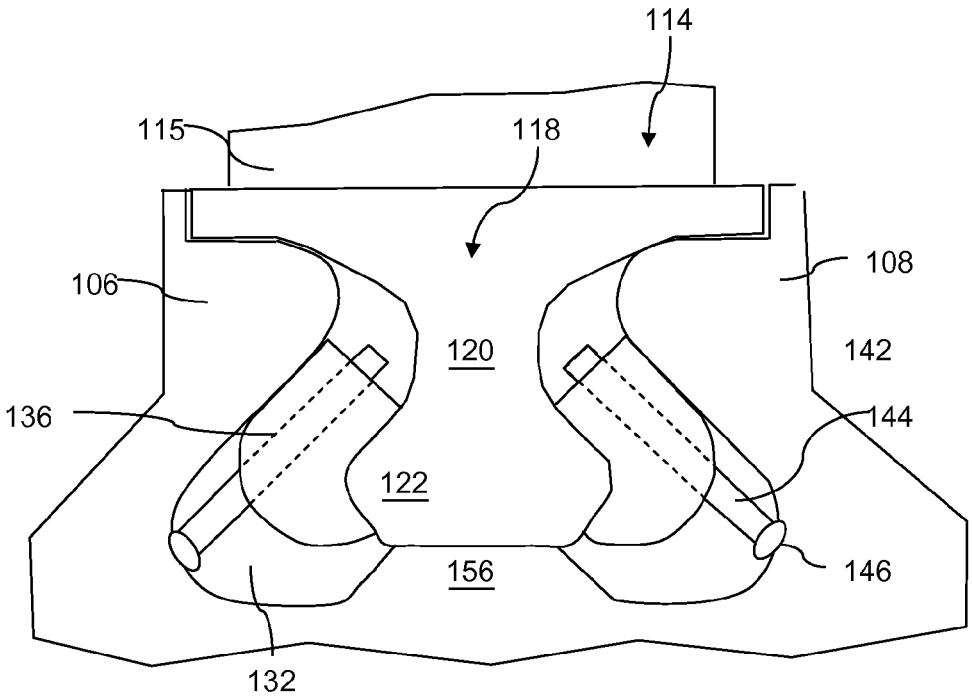
FIG. 7 is an end perspective view of the embodiment illustrated in FIG. 3.
Figure 8:
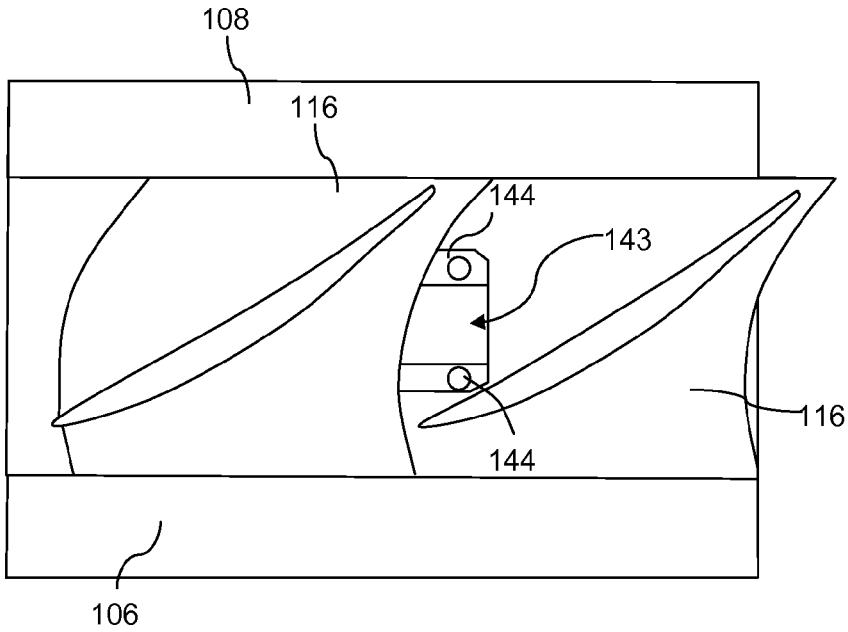
FIG. 8 is a top perspective view of the embodiment illustrated in FIG. 3 particularly illustrating an access opening in the rotor blade platform to the locking mechanism.

In order to radially draw the locking rail segments 136 outward to their operational position, and to lock the segments 136 in this position, a locking mechanism, generally 142, is provided with the retaining system. In the illustrated embodiment, this locking mechanism 142 includes threaded rods 144 that engage with a threaded bore or sleeve in the locking rail segments 136. The threaded rods 144 have a base 146 that is either seated against the arcuate surface 135 of the channels 132, or seated in a specially designed groove or recess within the dovetail slot 110. Access to the opposite ends of the threaded rods 144 is made available through an access opening 143 in the platform 116 of the last one or ones of the rotor blades 114, as particularly illustrated in FIG. 8. Referring to FIGS. 7 and 8, after the final rotor blade 114 has been inserted into the dovetail slot 110, the threaded rods are engaged through the opening 143 and rotated, causing radially outward advancement of the locking rail segments 136 into engagement with the dovetail lobes 122, until the locking rail segments 136 achieve their final locked configuration, as illustrated in FIGS. 6 and 7.

It should be readily appreciated that any manner of alternate locking or positioning mechanism may be utilized to position the locking rail segments 136 into engagement with the lobes 122 after insertion of the final one or ones of the dovetails 118. For example, such a mechanism may include a ratchet device, spring actuated device, and so forth.

For balance purposes, it may be desired that another locking rail segment configuration as described above, or equivalent balance structure, be mirrored on the rotor at a location 180° opposite of the locking rail segment 136.

Figure 9:
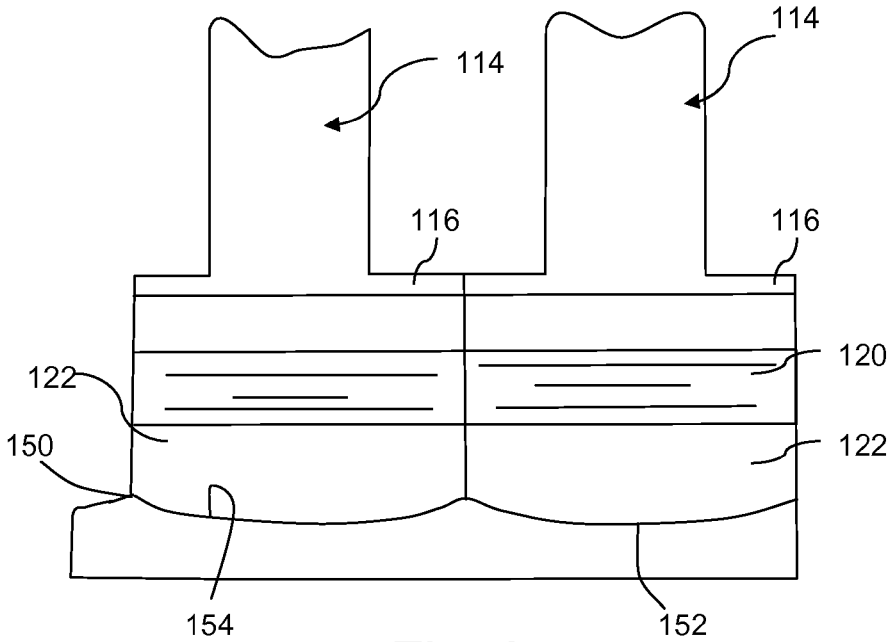
FIG. 9 is a side sectional view particularly illustrating the scalloped dovetail bottoms and dovetail recesses.

Referring to FIGS. 9 and 10, as a means to prevent rotation or slippage of the dovetails 118 within the dovetail slot 110, the dovetail bottoms 150 may have a scalloped surface 152 extending in the circumferential direction. Likewise, the bottom of the dovetail slots may include a series of individually scalloped recesses 154 extending in the circumferential direction. These recesses 154 may be defined in the raised ridge 156, as particularly illustrated in FIG. 10. In this configuration, each individual dovetail 118 has a scalloped bottom 152 that is seated within a defined scalloped recess 154. This configuration will reduce the likelihood of rotation or slippage of the dovetails 118 along the dovetail slot 110. It should be understood that the term "scalloped" is used herein to encompass any manner of concave or convex shape. For example, scalloped recesses may be defined in the dovetails 118, and scalloped protrusions defined in the raised ridge 156.

The unique dovetail retaining system of the present invention is believed to substantially reduce high mechanical stresses associated with traditional load/lock slot geometries of conventional circumferentially bladed gas turbine rotors, particularly compressor rotors, while maintaining full or nearly full pitch blade shanks. The configuration will also reduce limiting stresses generated in the dovetail neck and lobes, and in the rotor disk hoops. The unique configuration described herein allows for the insertion of a different material between the dovetail lobes and the rotor disk hoops to reduce wearing and/or galling at the component interfaces. It is believed that the unique configuration in accordance with aspects of the present invention will provide for full or nearly full pitch dovetails, which reduces average and peak stresses, provides increased shear area, and improves blade aeromechanics. Analysis indicates that the unique design of the present invention should produce significant improvements in shear stress reduction, bending stress reduction, average P/A stress reductions, and HCF margins, all of which should result in a longer overall rotor life. The present design may prove particularly beneficial at the aft end of a compressor where the metal temperatures are highest and material properties are negatively impacted.

The present design also offers advantages over prior art twist-in blades and load-lock slots for insertion of rotor dovetails within dovetail slots in that these prior systems required the dovetails to be much less than full pitch relative to circumferential length. The present design allows for a full or nearly full pitch design, which significantly eliminates average and peak stresses at the outer diameter of the rotor.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A dovetail retaining system for circumferential entry rotor dovetails, comprising:

a rotor having a rotor disk with forward and aft hoops defining a continuous circumferentially extending dovetail slot, said hoops defining a radially inward pressure face within said dovetail slot;

a plurality of rotor blades, each of said rotor blades comprising a platform and a dovetail extending from said platform, said dovetail having a neck and a pair of oppositely oriented lobes, each said lobe defining an outward pressure face, said dovetail circumferentially slidable into and along said dovetail slot such that said plurality of rotor blades are circumferentially spaced around said rotor disk within said dovetail slot;

a plurality of rail segments separate from said dovetails, each of said rail segments having a cross-sectional shape and arc length such that a pair of said rail segments circumferentially slide relative to said dovetails into channels in said dovetail slot between said dovetail lobes and said hoops, each of said rail segments defining a first pressure face that engages against said lobe outward pressure face, and a second pressure face that engages against said hoop inward pressure face.

2. The dovetail retaining system of claim 1, further comprising at least one pair of locking rail segments, each of said locking rail segments having a smaller cross-sectional shape than said plurality of rail segments so as to fit into said dovetail slot channels yet provide access for subsequent radial insertion of a last one of said dovetails into said dovetail slot, and further comprising a locking mechanism configured to draw each of said locking rail segments radially outward into engagement with said outward pressure faces of said lobes and said inward pressure faces of said hoops.

3. The dovetail retaining system as in claim 2, wherein said locking mechanism comprises a threaded rod for each of said locking rail segments that extends through said respective locking rail segment, and an access openings in said rotor blade platform aligned with said threaded rods, said locking rail segments advanced radially outward along said threaded rod upon rotation of said threaded rod through said access openings.

4. The dovetail retaining system as in claim 3, wherein said locking rail segments have a contoured profile that wraps around said lobes.

5. The dovetail retaining system as in claim 1, wherein said plurality of rail segments have an arc length so as to circumferentially extend along at least two adjacent said rotor blades.

6. The dovetail retaining system as in claim 1, wherein said dovetail comprises a bottom having a circumferentially extending scalloped surface, and said dovetail slot comprises a plurality of circumferentially extending scalloped recesses, each of said dovetail bottoms seated within a respective said scalloped recess.

7. The dovetail retaining system as in claim 6, wherein said dovetail slot comprises a bottom raised ridge, said circumferentially extending scalloped recesses defined in said raised ridge.

8. The dovetail retaining system as in claim 7, wherein said channels comprise lobe recesses defined on opposite sides of said raised ridge, said rail segments disposed in said lobe recesses.

9. The dovetail retaining system as in claim 1, wherein said plurality of rail segments have a contoured profile that wraps around said lobes.

10. The dovetail retaining system as in claim 1, wherein said dovetails and said dovetail slot comprises a symmetrical cross-sectional profile.

11. A dovetail retaining system for retaining circumferential entry rotor dovetails in a rotor having a rotor disk with forward and aft hoops that define a continuous circumferentially extending dovetail slot, said dovetail retaining system comprising:

a plurality of rotor blades, each of said rotor blades comprising a platform and a dovetail extending from said platform, said dovetail having a neck and a pair of oppositely oriented lobes, each said lobe defining an outward pressure face, said dovetail configured so as to circumferentially slide into and along the dovetail slot in the rotor disk such that said plurality of rotor blades are circumferentially spaced around the rotor disk within the dovetail slot;

a plurality of rail segments separate from said dovetails, each of said rail segments having a cross-sectional shape and arc length such that a pair of said rail segments circumferentially slide relative to said dovetails into channels in the dovetail slot between said dovetail lobes and the rotor disk hoops, each of said rail segments defining a first pressure face that engages against said lobe outward pressure face, and a second pressure face configured to engage against an inward hoop pressure face.

12. The dovetail retaining system of claim 11, further comprising at least one pair of locking rail segments, each of said locking rail segments having a smaller cross-sectional shape than said plurality of rail segments so as to fit into the dovetail slot channels yet provide access for subsequent radial insertion of a last one of said dovetails into the dovetail slot, and further comprising a locking mechanism configured to draw each of said locking rail segments radially outward into engagement with said outward pressure faces of said lobes and the hoop inward pressure faces.

13. The dovetail retaining system as in claim 12, wherein said locking mechanism comprises a threaded rod for each of said locking rail segments that extends through said respective locking rail segment, and an access opening in said rotor blade platform aligned with said threaded rods, said locking rail segments advanceable radially outward along said threaded rod upon rotation of said threaded rod through said access openings.

14. The dovetail retaining system as in claim 13, wherein said locking rail segments have a contoured profile that wraps around said lobes.

15. The dovetail retaining system as in claim 11, wherein said plurality of rail segments have an arc length so as to circumferentially extend along at least two adjacent said rotor blades.

16. The dovetail retaining system as in claim 11, wherein said dovetail comprises a bottom having a circumferentially extending scalloped surface that engages in a circumferentially extending scalloped recess in the dovetail bottom.

17. The dovetail retaining system as in claim 11, wherein said plurality of rail segments have a contoured profile that wraps around said lobes.

18. A method for retaining circumferential entry rotor dovetails in a circumferentially extending dovetail slot defined between radially inward faces of rotor disc hoops, the dovetails extending from a rotor blade platform and having a neck and a pair of oppositely oriented lobes, said method comprising:

inserting the dovetails into the dovetail slot;

after insertion of the dovetails, circumferentially sliding rail segments into channels in the dovetail slot defined between the dovetail lobes and the hoop inward faces, the rail segments engaging outward pressure faces of the lobes and inward pressure faces of the hoops to transfer and distribute centrifugal load of the rotor blades to the rotor disk.

19. The method of claim 18, further comprising inserting locking rail segments into the channels prior to radially inserting the last one of the dovetails into the dovetail slot, and thereafter drawing the locking rail segments radially outward within the channels so as to engage the outward pressure faces of the lobes and inward pressure faces of the hoops.

20. The method of claim 19, further comprising drawing the locking rail segments radially outward by engaging a locking mechanism provided with each locking rail segment through an access opening in the rotor blade platform.

* * * * *